US006285284B1

(12) United States Patent
Soe et al.

(10) Patent No.: US 6,285,284 B1
(45) Date of Patent: Sep. 4, 2001

(54) THEFT PREVENTIVE TAG AND METHOD FOR ATTACHING THE SAME

(75) Inventors: Takeshi Soe; Masami Miyake; Minoru Nakazato; Kouichi Ishiyama, all of Omiya (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/424,588

(22) PCT Filed: Mar. 1, 1999

(86) PCT No.: PCT/JP99/00978

§ 371 Date: Nov. 24, 1999

§ 102(e) Date: Nov. 24, 1999

(87) PCT Pub. No.: WO99/49437

PCT Pub. Date: Sep. 30, 1999

(30) Foreign Application Priority Data

Mar. 24, 1998 (JP) ..... 10/75217
Dec. 21, 1998 (JP) ..... 10/363183

(51) Int. Cl.[7] ..... G08B 13/14

(52) U.S. Cl. ..... 340/572.1; 340/572.5; 340/572.6

(58) Field of Search ..... 340/572.1, 572.5, 340/572.6, 572.7; 428/611; 29/825, 829, 846; 361/816

(56) References Cited

U.S. PATENT DOCUMENTS 4,985,288 * 1/1991 Matsumoto et al. ..... 428/40
5,059,950 * 10/1991 Perchak ..... 340/572.4
5,477,219 * 12/1995 Zarembo et al. ..... 340/572.4
5,605,768 * 2/1997 Furukawa et al. ..... 428/611
5,751,256 * 5/1998 McDonough et al. ..... 343/873
5,777,553 * 7/1998 Perreau et al. ..... 340/551
5,912,622 6/1999 Endo et al. ..... 340/572.5
6,018,298 * 1/2000 Endo et al. ..... 340/572.5
6,067,016 * 5/2000 Deschenes et al. ..... 340/572.8
6,087,940 * 7/2000 Caperna et al. ..... 340/572.5

* cited by examiner

*Primary Examiner*—Daniel J. Wu
*Assistant Examiner*—Toan Pham
(74) *Attorney, Agent, or Firm*—Oblon, Spivak, McClelland, Maier & Neustadt, P.C.

(57) ABSTRACT

The resonance frequency of a resonant circuit section does not change even if the surface of an article whose theft is monitored is formed of any material. An antitheft tag mounted on the article (11) whose theft is monitored includes a resonant circuit section resonating with the radio wave having a particular frequency and transmitted from a transmitting antenna. An electromagnetic shield layer formed of an insulating material is interposed between the mounting surface of the article and the resonant circuit section. The electromagnetic shield layer may be formed of ferrite powder or soft magnetic powder which has a particle size of 10 $\mu$m or less and plastic or rubber or may be formed by laminating a first layer composed of a composite material and a second layer composed of plastic or rubber. Preferably, the soft magnetic powder is any of amorphous alloy, Permalloy, soft magnetic iron, silicon steel, Sendust alloy and Fe—Al alloy.

10 Claims, 7 Drawing Sheets

11/ ARTICLE
13/ TRANSMITTING ANTENNA
52/ TAG
54/ RESONANT CIRCUIT SECTION
55/ HIGH CONDUCTIVITY LAYER
56/ ELECTROMAGNETIC SHIELD LAYER
56A/ FIRST LAYER
56B/ SECOND LAYER

11/ ARTICLE
12/ TAG
14/ RESONANT CIRCUIT SECTION
16/ ELECTROMAGNETIC SHIELD LAYER

11/ ARTICLE
12/ TAG
13/ TRANSMITTING ANTENNA
23/ RECEIVING ANTENNA
24/ CONTROLLER
26/ SPEAKER

11/ ARTICLE
13/ TRANSMITTING ANTENNA
52/ TAG
54/ RESONANT CIRCUIT SECTION
55/ HIGH CONDUCTIVITY LAYER
56/ ELECTROMAGNETIC SHIELD LAYER
56A/ FIRST LAYER
56B/ SECOND LAYER

11/ ARTICLE
12/ TAG
13/ TRANSMITTING ANTENNA
23/ RECEIVING ANTENNA
24/ CONTROLLER
26/ SPEAKER
61/ SMALL SPACE

THEFT PREVENTIVE TAG AND METHOD FOR ATTACHING THE SAME

BACKGROUND OF THE INVENTION

1. Field of the Invention

The present invention relates to a tag for notifying that an article the theft of the which is monitored is taken out without permission and to a method of mounting the tag.

2. Description of the Related Art

Conventionally, there is disclosed, as this type of antitheft tags, an antitheft tag arranged such that the resonant circuit section of a tag mounted on an article whose theft is monitored is in resonance with the radio wave having a particular frequency and transmitted from a radio wave transmitter, a separation sensing means senses whether or not the tag is separated from the article whose theft is monitored and a separation notifying unit controls a notifying sound output means based on the sensed output from the separation sensing means (Japanese Unexamined Patent Publication No. 8-185584). In the antitheft tag, the resonant circuit section is composed of conductive metal foils having a predetermined shape which are formed on both the sides of an insulting dielectric thin film by etching or the like. For example, a dielectric circuit portion and a capacitor circuit portion are formed on the front surface of the thin film as a front surface flat pattern. The dielectric circuit portion is composed of a conductive metal foil and formed to a swirl shape, and the capacitor circuit portion is formed so as to continue to the center of the swirl of dielectric circuit portion. The separation sensing means is a removal sensing switch having an actuating lever which projects to the surface of the tag on which the tag is mounted. A power supply and a buzzer are electrically connected to the sensing switch. The separation notifying unit is a circuit composed of the removal sensing switch, the power supply and the buzzer which acts as the notifying sound output means. When the tag is mounted on the article, the actuating lever is pressed by the article, whereby the removal sensing switch is turned off. Whereas, when the tag is removed from the article, the actuating lever projects, whereby the removal sensing switch is turned on.

Further, a transmitting antenna and a receiving antenna stand at a predetermined interval at the entrance and the exit of a shop where the article whose theft is monitored is sold. These antennas are electrically connected to a controller. The controller causes the transmitting antenna to transmit a radio wave having a frequency with which the resonant circuit section resonates as well as checks the signal level of the signal received by the receiving antenna at all times. Further, a speaker for issuing a warning is connected to the control output of the controller.

In the antitheft tag arranged as described above, when the article whose theft is monitored is going to pass between the transmitting antenna and the receiving antenna regardless of that the price for it is not paid, the receiving antenna receives a signal whose receiving level is modulated because the radio wave transmitted from the transmitting antenna is resonated by the resonant circuit section of the tag mounted on the article whose theft is monitored. As a result, the controller issues a warning from the speaker so that the taking-out of the article whose price is not paid can be checked. In contrast, when the tag is removed from the article, the sensing switch is turned on by the projection of the actuating lever and the buzzer is sounded. Thus, the theft of the article can be reliably monitored.

However, in the conventional antitheft tag, when the tag is mounted on an article whose surface is formed of a conductive material such as aluminum and the like or a ferromagnetic material such as a steel sheet and the like, the resonance frequency of the resonant circuit section is changed and the tag is not resonated sometimes as compared with a case that the tag is mounted on an article whose surface is formed of an insulating material and a non-magnetic material because the self-inductance of the resonant circuit section changes.

An object of the present invention is to provide an antitheft tag having a resonant circuit section whose resonance frequency does not change depending upon the material of the surface of an article whose theft is monitored and a method of mounting the antitheft tag.

Another object of the present invention is to provide an antitheft tag whose thickness can be reduced and which can be made at a low cost and a method of mounting the antitheft tag.

SUMMARY OF THE INVENTION

An invention according to a first aspect of the invention relates to the improvement of an antitheft tag which is mounted on an article, the theft of which is monitored and which includes a resonant circuit section resonating with the radio wave having a particular frequency and transmitted from a transmitting antenna.

The characteristic arrangement of the invention resides in that an electromagnetic shield layer is interposed between the mounting surface of the article and the resonant circuit section.

In the antitheft tag, when the resonant circuit section is mounted on the article whose surface is formed of a conductive material such as aluminum or the like or a ferromagnetic material such as steel sheet or the like through the electromagnetic shield layer, the resonant circuit section is electromagnetically shielded from the article by the electromagnetic shield layer. Accordingly, the self-inductance of the resonant circuit section does not almost change from the self-inductance thereof when it is mounted on an article whose surface is formed of an insulating material or a non-magnetic material.

In the antitheft tag, a high conductivity layer may be interposed between the mounting surface of the article and the electromagnetic shield layer.

In the antitheft tag, the resonant circuit section is electromagnetically shielded from the article by the electromagnetic shield layer as well as the Q value of the resonant circuit section is increased by the high conductivity layer. As a result, the self-inductance of the resonant circuit section does not almost change and a resonant width is made sharp. In addition, the thickness of the electromagnetic shield layer can be greatly reduced by interposing the thin high conductivity layer and further the tag can be made at a low cost. Note that the Q value is a value defined by $\omega L/r$ when an angular frequency is represented by $\omega$ and the resistance component of the resonant circuit section is represented by r. It is known that a loss caused by an eddy current and the like is reduced and the resonant width is made sharp by a higher Q value. Further, a reason why the Q value is increased by interposing the high conductivity layer as described above is that the self-inductance L of the resonant circuit section is not almost changed by the material of the article located just below the high conductivity layer. This is because the electromagnetic wave transmitted from the transmitting antenna is shielded by the high conductivity layer and does not reach the article located just below the high conductivity layer.

In the antitheft tag, the electromagnetic shield layer may be formed of an insulating material.

In the antitheft tag, when the resonant circuit section is mounted on the article whose surface is formed of a conductive material such as aluminum or the like or a ferromagnetic material such as the steel sheet or the like through the electromagnetic shield layer, the resonant circuit section is electromagnetically shielded from the article by the electromagnetic shield layer while being space apart therefrom by a predetermined interval which corresponds to the thickness of the electromagnetic shield layer. As a result, the self-inductance of the resonant circuit section does not almost change from that when the resonant circuit section is mounted on the article whose surface is formed of an insulating material or a non-magnetic material.

In the antitheft tag, the electromagnetic shield layer may be composed of a composite material of ferrite powder and plastic or rubber.

Ferrite is an oxide represented by a chemical formula MO $Fe_2O_3$ when bivalent metal ions are represented by M. It is known that the ferrite generally has a very high electric resistance and high magnetic permeability. Note that Mn, Mg, Ni, Co, Cu and Zn are exemplified as the bivalent metal ions, and the ferrite powder may be sintered ferrite powder obtained by pulverizing sintered ferrite.

Used as plastic in which the ferrite powder is dispersed is thermoplastic resin such as polyvinyl chloride resin, polyethylene resin, ABS resin, polypropylene resin, polyester resin, polyamide resin, fluororesin and the like and thermosetting resin such as epoxy resin, phenol resin, silicone resin, urethane resin and the like. Further, the resin in which the powder is dispersed is not limited thereto and natural rubber or synthetic rubber may be used.

In the antitheft tag, the electromagnetic shield layer may be composed of a composite material of soft magnetic powder which has a particle size of 10 $\mu$m or less and plastic or rubber.

The particle size of the soft magnetic powder must be 10 $\mu$m or less because it is blended with or dispersed in the plastic or the rubber to prevent an eddy current from being occurred in the soft magnetic powder by the radio wave transmitted from a transmission antenna. The particle size is preferably 5 $\mu$m or less and more preferably 3 $\mu$m or less.

In the antitheft tag, when the resonant circuit section is mounted on the article whose surface is formed of the conductive material such as the aluminum or the like or the ferromagnetic material such as the steel sheet or the like through the electromagnetic shield layer, the resonant circuit section is electromagnetically shielded from the article by the ferrite powder or the soft magnetic powder having a high permeability and contained in the electromagnetic shield layer. Accordingly, even if the thickness of the electromagnetic shield layer is reduced, the self-inductance of the resonant circuit section does not almost change from that when it is mounted on the article whose surface is formed of the insulating material or the non-magnetic material.

In the antitheft tag, the electromagnetic shield layer may be formed by laminating a first layer composed of a composite material of ferrite powder or soft magnetic powder which has a particle size of 10 $\mu$m or less and plastic or rubber and a second layer composed of plastic or rubber.

In the antitheft tag, the second layer acts as an insulating layer. When the resonant circuit section is mounted on the article whose surface is formed of the conductive material such as the aluminum or the like or the ferromagnetic material such as the steel sheet or the like through the electromagnetic shield layer, the self-inductance of the resonant circuit section does not almost change from that when the resonant circuit section is mounted on the article whose surface is formed of the insulating material or the non-magnetic material while the thickness of the electromagnetic shield layer is reduced as well as the amount of the ferrite powder or the soft magnetic powder used is reduced.

In the antitheft tag, the soft magnetic powder may be composed of any of amorphous alloy, Permalloy, soft magnetic iron, silicon steel, Sendust alloy and Fe—Al alloy.

Used as the amorphous alloy is highly permeable material of cobalt, iron, nickel and the like. The amorphous alloy contains Co, Fe and Ni in an amount of 70–98 wt % in total, B, Si and P in an amount of 2–30 wt % in total and Al, Mn, Zr, Nb and the like in addition to the above.

Exemplified as specific examples of the cobalt alloy are an alloy composed of 84 wt % of Co, 5.3 wt % of Fe, 8.5 wt % of Si and 2.2 wt % of B, an alloy composed of 84 wt % of Co, 3.3 wt % of Fe, 1.3 wt % of B, 9.8 wt % of P, and 1.6 wt % of Al, an alloy composed of 89 wt % of Co, 5.3 wt % of Fe, 2.3 wt % of Si, 3.4 wt % of B, an alloy composed of 81.9 wt % of Co, 5.1 wt % of Fe, 10 wt % of Si and 3 wt % of B, an alloy composed of 80 wt % of Co, 10 wt % of Fe, 6 wt % of Si and 4 wt % of B, and an alloy composed of 78.8 wt % of Co, 5.1 wt % of Fe, 6.1 wt % of Si, 4.7 wt % of B and 5.3 wt % of Ni.

Exemplified as specific examples of the iron alloy are an alloy composed of 95.4 wt % of Fe and 4.6 wt % of B, an alloy composed of 91.4 wt % of Fe, 5.9 wt % of Si and 2.7 wt % of B, and the like.

Exemplified as specific examples of the nickel alloy are an alloy composed of 94.5 wt % of Ni and 5.5 wt % of P, and the like.

Used as the Permalloy are 78-Permalloy, 45-Permalloy, Hipernik, Monimax, Sinimax, Radiometal, 1040 Alloy, Mumetal, Cr-Permalloy, Mo-Permalloy, Super malloy, Hardperm, 36-Permalloy, Deltamax, square hysteresis Permalloy, JIS PB types 1 and 2, JIS PC types 1 to 3, JIS PD types 1 and 2, JIS PE types 1 and 2, and the like.

Used as the soft magnetic iron are industrial pure iron, Armco iron, Cioffi pure iron, low carLon steel and the like.

Used as the silicon steel are non-directional silicon steel, directional silicon steel, and the like.

Used as the Sendust alloy and the Fe—Al alloy are alperm, hypermal, Sendust, super Sendust, and the like.

When the above insulating materials are used as the insulating layer in the antitheft tag according to the seventh aspect of the invention, the resonant circuit section can be reliably magnetically shield from the article whose surface is formed of the conductive material or the ferromagnetic material because they have high magnetic permeability, small coercive force, and a small hysteresis loss.

In the antitheft tag, the high conductivity layer may be formed of a non-magnetic material having an electric resistivity of $10^{-2}$ $\Omega$·cm or less.

In the antitheft tag, the high conductivity layer may be formed of any of an aluminum sheet, a copper sheet, an aluminum foil, an ITO film and a silver thick film.

In the antitheft tag, since the high conductivity layer is formed of the non-magnetic aluminum sheet or the like which has high conductivity, the Q value can be increased.

An invention according to a second aspect of the invention is a method of mounting the antitheft tag according to the first aspect of the invention on an article whose theft is monitored using the front surface of the electromagnetic shield layer of the tag as the surface to be mounted on the article.

With this method, the antitheft tag can be properly mounted on the article whose theft is monitored without being affected by the article.

In the method, the antitheft tag may be mounted on the article whose theft is monitored using the front surface of the high conductivity layer of the tag as the surface to be mounted on the article.

With this method, the antitheft tag can be more properly mounted on the article whose theft is monitored without being affected by the article as compared with the antitheft tag wherein the high conductivity layer may be formed of any of an aluminum sheet, a copper sheet, an aluminum foil, an ITO film and a silver thick film.

DESCRIPTION OF THE PREFERRED EMBODIMENTS

A first embodiment of the present invention will be described based on the drawings.

Figure 1:
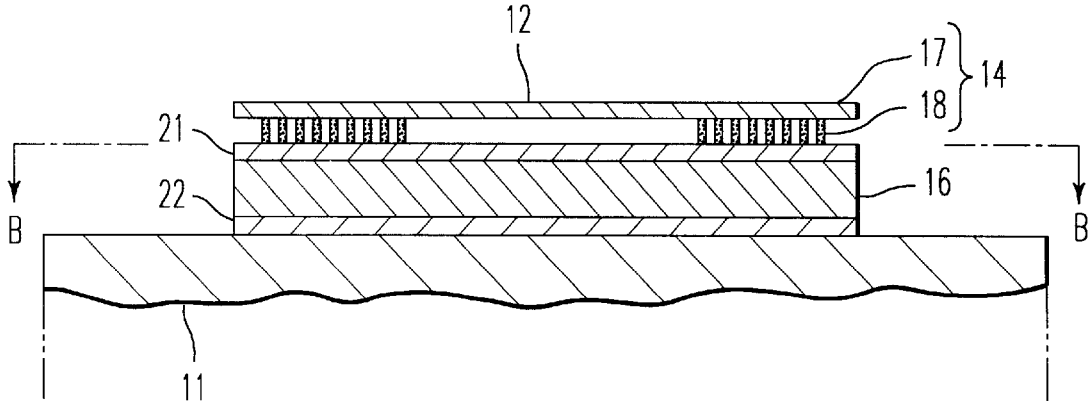
FIG. 1 is a sectional view taken along the line A—A of FIG. 2 showing an antitheft tag of a first embodiment of the present invention.
Figure 2:
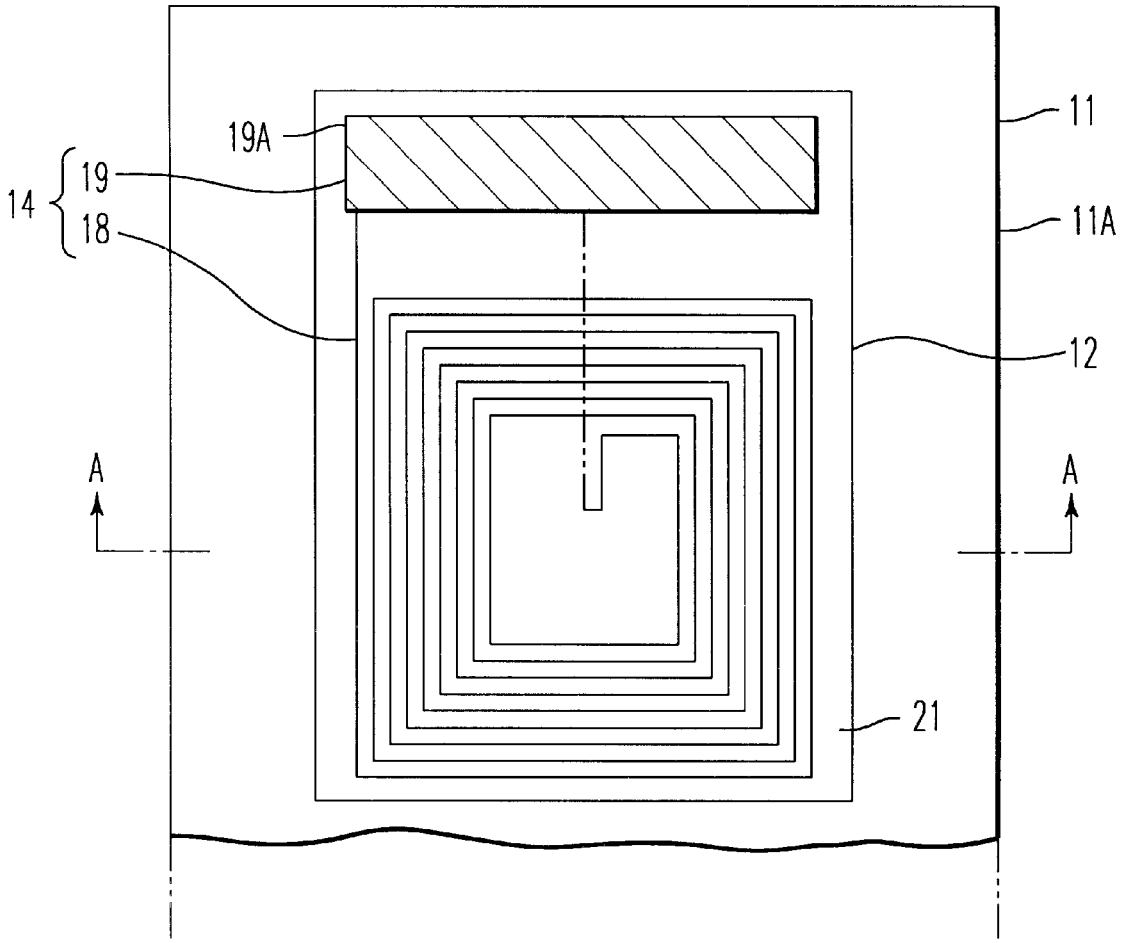
FIG. 2 is a sectional view taken along the line B–B of FIG. 1.
Figure 3:
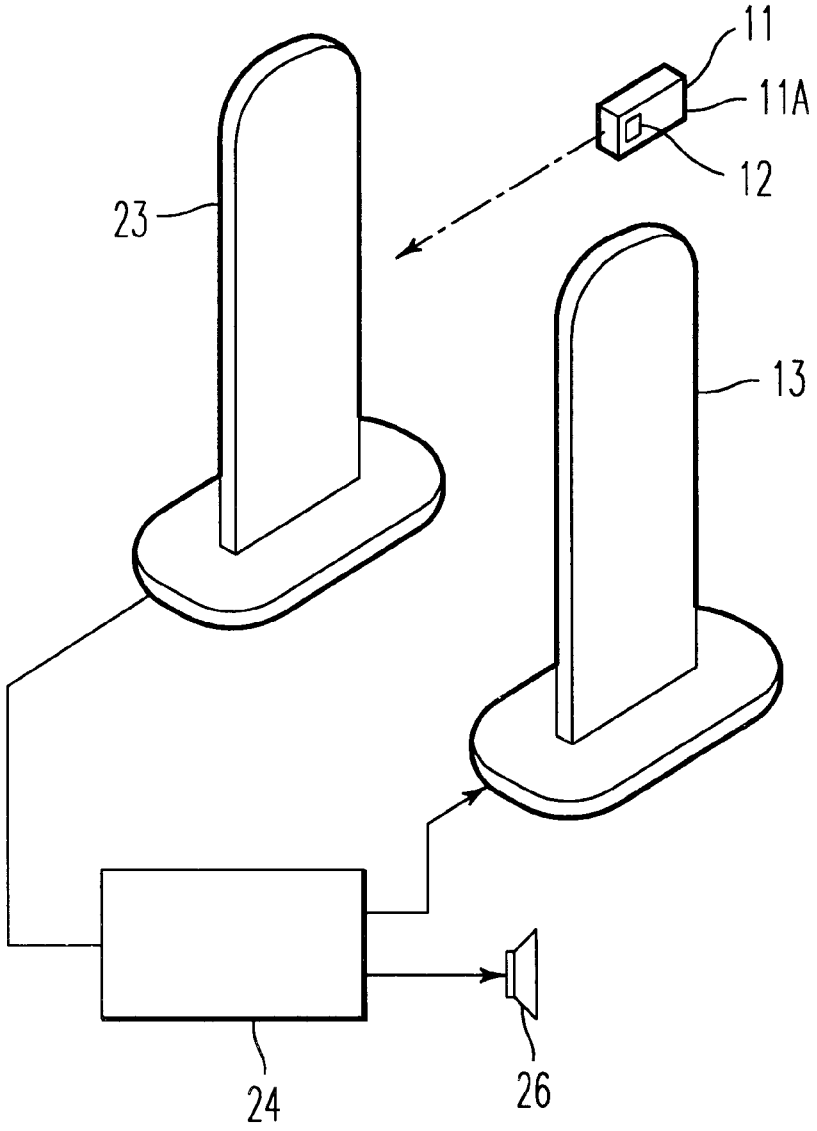
FIG. 3 is a view showing a state that an article on which the tag is mounted passes between a transmitting antenna and a receiving antenna.

As shown in FIG. 1 to FIG. 3, a tag 12 mounted on an article 11 whose theft is monitored includes a resonant circuit section 14 and an electromagnetic shield layer 16. The resonant circuit section 14 is in resonance with the radio wave having a particular frequency and transmitted from a transmitting antenna 13, and the electromagnetic shield layer 16 is interposed between the article 11 and the resonant circuit section 14. In the embodiment, the article 11 is drink water, cooking oil, candies or the like accommodated in a vessel 11*a* made of a steel sheet which is a ferromagnetic material. The resonant circuit section 14 comprises an insulating base sheet 17, a coil portion 18 and a capacitor 19. The insulating base sheet 17 is formed of an insulating material such as a paper, a plastic thin sheet or the like, the coil portion 18 is formed of a conductive material such as copper, aluminum or the like to an approximately square swirl shape on one of the surfaces of the insulating base sheet 17, the coil portion 18 bonded to the one of the surfaces of the insulating base sheet 17, and the capacitor 19 is bonded to the one of the surfaces of the insulating base sheet 17 and electrically connected to the coil portion 18 (FIGS. 1 and 2). The capacitor 19 is composed of a pair of electrode layers 19*a* bonded to each other through a dielectric layer (not shown). The coil portion 18 is formed by winding an insulated conductive wire to an approximately square swirl shape and bonding it to the insulating base sheet 17. Alternatively, the coil portion 18 is made of a conductive material such as an aluminum foil, a copper foil or the like laminated on the insulating base sheet 17 and formed to an approximately square swirl shape by removing an unnecessary portion therefrom by etching, punching or the like.

The electromagnetic shield layer 16 is formed of an insulating material such as a styrol sheet or an acrylic sheet or the like or formed of a composite material of ferrite powder and plastic or rubber or a composite material of soft magnetic powder having a particle size of 10 $\mu$m or less and plastic or rubber. The formation of the electromagnetic shield layer 16 of the composite material permits the reduction of the thickness thereof. When the electromagnetic shield layer 16 is formed of the insulating material, it is preferable that the thickness thereof is within the range of 5 mm–10 mm, whereas when the electromagnetic shield layer 16 is formed of the composite material, it is preferable that the thickness thereof is within the range of 3 mm–5 mm. Further, the electromagnetic shield layer 16 may be formed by laminating a first layer composed of the composite material and a second layer composed of plastic or rubber. When the electromagnetic shield layer 16 is formed by laminating the first layer and the second layer, the thickness of the first layer can be reduced as well as the amount of the ferrite powder or the soft magnetic powder used can be reduced. When the electromagnetic shield layer 16 is formed by laminating the first layer and the second layer, it is preferable that the thicknesses of the first and second layers are within the ranges of 2 to 4 mm and 2–5 mm, respectively.

Note that, preferably, the composite material or the first layer is formed by blending and solidifying ferrite powder or soft magnetic powder in the range of 80–95 wt % and plastic or rubber in the range of 5–20 wt %. While the area of the electromagnetic shield layer 16 is approximately the same as that of the resonant circuit section 14 in the figure, it is needless to say that the effect of the electromagnetic shield layer 16 can be more exhibited by making the area of the electromagnetic shield layer 16 larger than that of the resonant circuit section 14. Note that when the soft magnetic powder having a particle size of 10 $\mu$m or less, it is preferable to use any of amorphous alloy, Permalloy, soft magnetic iron, silicon steel, Sendust alloy and Fe—Al alloy as the soft magnetic powder.

The electromagnetic shield layer 16 is formed to a flat-sheet-shape having an area approximately the same as that of the insulating base sheet 17 and bonded to the one of the surfaces of the insulating base sheet 17, on which the coil portion 18 and the capacitor 19 are formed, through an adhesive layer 21. The electromagnetic shield layer 16 bonded to the insulating base sheet 17 is mounted on the front surface of the article 11, that is, on the front surface of the steel sheet vessel 11*a* through an adhesive layer 22 (FIG. 1–FIG. 3). The tag 12 is mounted in a state that the electromagnetic shield layer 16 is interposed between the resonant circuit section 14 and the article 11 whose theft is monitored. Incidentally, the transmitting antenna 13 and a receiving antenna 23 stand at the entrance and the exit (not shown) of a shop where the article 11 is sold (FIG. 3) at a predetermined interval (FIG. 3). The receiving antenna 23 is connected to the control input of a controller 24 and the transmitting antenna 13 is connected to the control output of the controller 24. Further, a speaker 26 for issuing a warning is connected to the control output of the controller 24.

The controller 24 causes the transmitting antenna 13 to transmit a radio wave having a frequency with which the resonant circuit section 14 resonates as well as checks the signal level of the signal received by the receiving antenna 23 at all times. That is, the signal level of the radio wave, which is transmitted from the transmitting antenna 13 and directly received by the receiving antenna 23, is used as a reference value. When the radio wave transmitted from the transmitting antenna 13 is received by the receiving antenna 23 after it is resonated by the resonant circuit section 14 of the transmitting antenna 13, the signal level of the radio wave is larger than the reference value by a predetermined value, and, at the time, the controller 24 causes the speaker 26 to sound.

Operation of the antitheft tag arranged as described above will be described.

When the article 11, on which the tag 12 is mounted, is caused to pass between the transmitting antenna 13 and the receiving antenna 23 so that it is taken out from the shop without permission, the resonant circuit section 14 receives the radio wave transmitted from the transmitting antenna 13 and resonates therewith. At the time, since the resonant circuit section 14 is electromagnetically shielded from the steel sheet vessel 11*a* of the article 11 by the electromagnetic shield layer 16, the self-inductance of the resonant circuit section 14 does not almost change. As a result, a radio wave having a frequency which is predetermined by the self-inductance of the coil portion 18 and the capacitance of the capacitor 19 is re-emitted from the resonant circuit section 14. When the receiving antenna 23 receives the re-emitted radio wave, the speaker 26 sounds and issues a warning because the controller 24 senses that the article 11 whose price is not paid is taken out without permission based on the received signal.

In contrast, when payment is made to the article 11, the capacitor 19 of the resonant circuit section 14 is broken by a strong radio wave emitted to the tag 12 at an accounting counter (not shown). As a result, even if the article 11 passes between the transmitting antenna 13 and the receiving antenna 23, the controller 24 does not sound the speaker 26 because the resonant circuit section 14 does not resonate.

Figure 5:
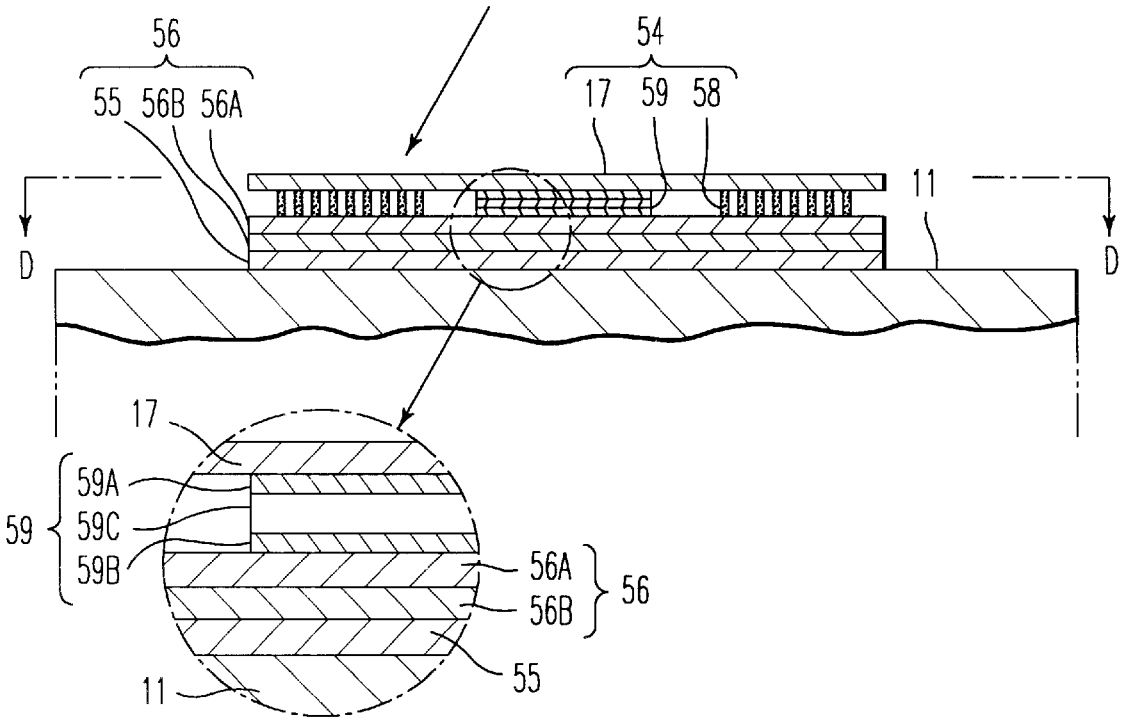
FIG. 5 is a sectional view taken along the line C–C of FIG. 6 showing a second embodiment of the present invention.
Figure 6:
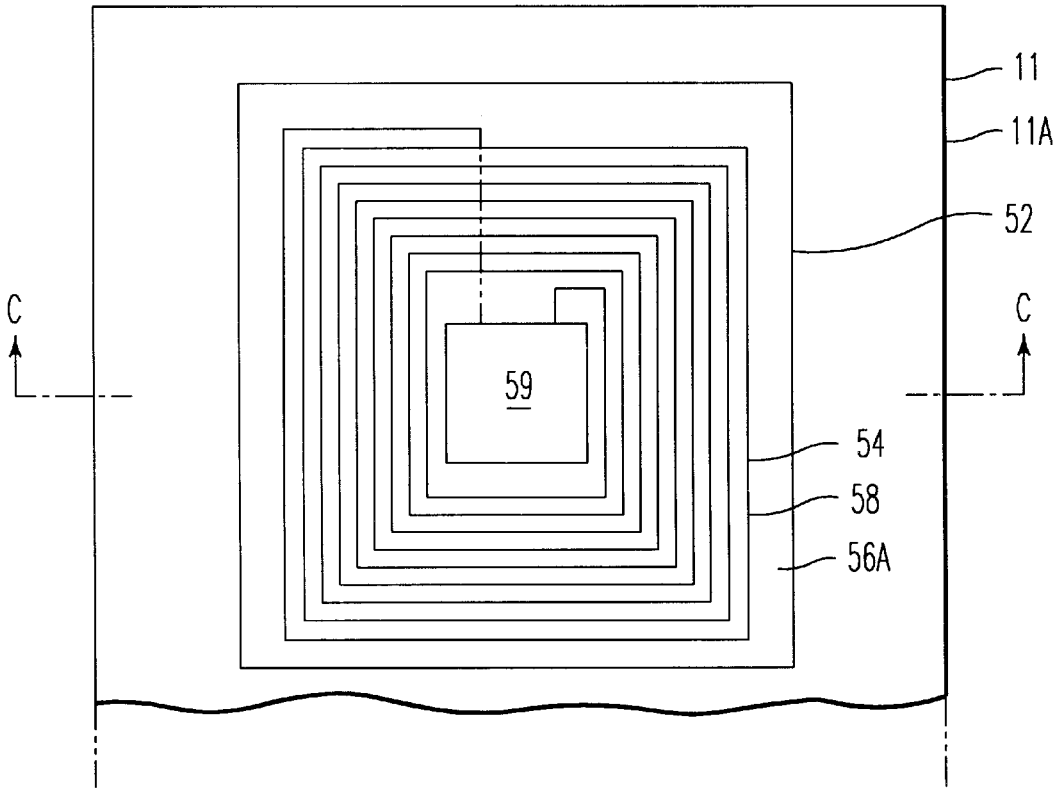
FIG. 6 is a sectional view taken along the line D–D of FIG. 5.

FIGS. 5 and 6 show a second embodiment of the present invention. The same numerals as used in FIGS. 1 and 2 are used to denote the same parts in FIGS. 5 and 6.

In the second embodiment, a high conductivity layer 55 is interposed between the mounting surface of an article 11 and an electromagnetic shield layer 56. The high conductivity layer 55 is bonded between the mounting surface of the article 11 and the electromagnetic shield layer 56 through an adhesive layer (not shown). The high conductivity layer 55 has an electric resistivity of $10^{-2}$ Ω·cm or less (conductivity is larger than $10^4$ S/m or more) as well as is formed to a sheet-, foil-, or film-shape. Specifically, it is preferable that the high conductivity layer 55 is formed of an aluminum sheet, a copper sheet, an aluminum foil, an ITO film, a silver thick film or the like. Further, the thickness of the high conductivity layer 55 is preferably within the range of 0.1–1.0 mm when it is formed of the aluminum sheet or the copper sheet, preferably within the range of 10–100 μm when it is formed of the aluminum foil or the silver thick film, and preferably within the range of 1–10 μm when it is formed of the ITO film. In the specification, the aluminum sheet and the copper sheet include not only a sheet and a foil formed of aluminum but also a sheet and a foil formed of Al alloy mainly composed of aluminum, and the copper sheet includes not only a sheet formed of copper but also a sheet formed of copper alloy mainly composed of copper. Further, the ITO film is a transparent highly conductive thin film which is formed of indium tin oxide composed of $In_2O_3$ to which about 8–12 mol % of $SnO_2$ is added.

In the second embodiment, the electromagnetic shield layer 56 is formed by laminating a first layer 56*a* and a second layer 56*b*. The first layer 56*a* is composed of a composite material which is composed of ferrite powder or soft magnetic powder which has a particle size of 10 μm or less and plastic or rubber, and the second layer 56*b* is composed of plastic or rubber. Note that the electromagnetic shield layer 56 may be formed of an insulating material such as a styrol sheet, an acrylic sheet or the like. Otherwise, it may be formed of a composite material of ferrite powder and plastic or rubber or formed of soft magnetic powder which has a particle size of 10 μm or less and plastic or rubber.

In the electromagnetic shield layer 56 formed by laminating the first layer 56*a* and the second layer 56*b*, the thickness of the first layer 56*a* can be more reduced than that of the electromagnetic shield layer of the first embodiment by the existence of the high conductivity layer, whereby the amount of the ferrite powder or the soft magnetic powder used can be reduced. When the electromagnetic shield layer 56 is formed by laminating the first layer 56*a* and the second layer 56*b*, preferably, the thicknesses of the first layer 56*a* and the second layer 56*b* is within the ranges 0.5–3 mm and 1–3 mm, respectively. Further, the formation of the electromagnetic shield layer of the insulating material permits the thickness thereof to be reduced. When the electromagnetic shield layer is formed of the insulating material, the thickness thereof is preferably within the range of 5–10 mm, whereas when the electromagnetic shield layer is formed of the composite material, the thickness thereof is preferably within the range of 1–3 mm.

Note that the content of the ferrite powder or the soft magnetic powder in the first layer or the composite material can be made smaller than that in the first embodiment by the existence of the high conductivity layer, and it is preferable to form the first layer or the composite material by blending and solidifying the ferrite powder or the soft magnetic powder in the range of 80–95 wt % and the plastic or the rubber in the range of 5–20 wt %. Further, the capacitor 59 of a resonant circuit section 54 is disposed in a coil portion 58 and includes first and second electrode layers 59*a* and 59*b* and a dielectric layer 59*c* interposed therebetween. The second embodiment is arranged similarly to the first embodiment except the above arrangement.

Operation of an antitheft tag 52 arranged as described above will be described based on FIGS. 5–7.

When the article 11, on which the tag 52 is mounted, is caused to pass between a transmitting antenna 13 and a receiving antenna 23 so that it is taken out from a shop without permission, the resonant circuit section 54 of the tag 52 receives the radio wave transmitted from the transmitting antenna 13 and resonates therewith. At the time, since the resonant circuit section 54 is electromagnetically shielded from the steel sheet vessel 11*a* of the article 11 by the electromagnetic shield layer 56 and the Q value of the resonant circuit section 54 is increased thereby, the self-inductance of the resonant circuit section 54 does not almost change, whereby a resonant width is made sharp. As a result, a radio wave having a frequency which is predetermined by the self-inductance of the coil portion 58 and the capacitance of the capacitor 59 is re-emitted from the resonant circuit section 54. Since the operation of the second embodiment other than the above is the same as that of the first embodiment, the description thereof is not repeated again.

Note that while the drink water, cooking oil and candies accommodated in the steel sheet vessel as a ferromagnetic material are exemplified as the article in the first and second embodiments, the embodiments are also applicable to the drink water or the like accommodated in an aluminum vessel as a conductive material or to an article formed of an insulating material, a non-magnetic material and any other material. When the article is a book, the tag of the present invention can be bonded to a sales slip by an adhesive. When the book is bought by paying the price for it, the sales slip is removed therefrom at an accounting counter. Thus, the speaker issues no warning even if the book is caused to pass between the transmitting antenna and the receiving antenna.

While the coil portion is formed to the approximately square swirl shape in the first and second embodiments, it may be formed to an approximately circular swirl shape or other swirl shape.

Further, the electromagnetic shield layer is mounted on the surface of the article through the adhesive layer in the first and second embodiments, it may be mounted on the surface of the article through an adhesive tape having an adhesive agent applied to both the sides thereof.

Next, examples of the present invention will be described in detail together with comparative examples.

EXAMPLE 1

Figure 4:
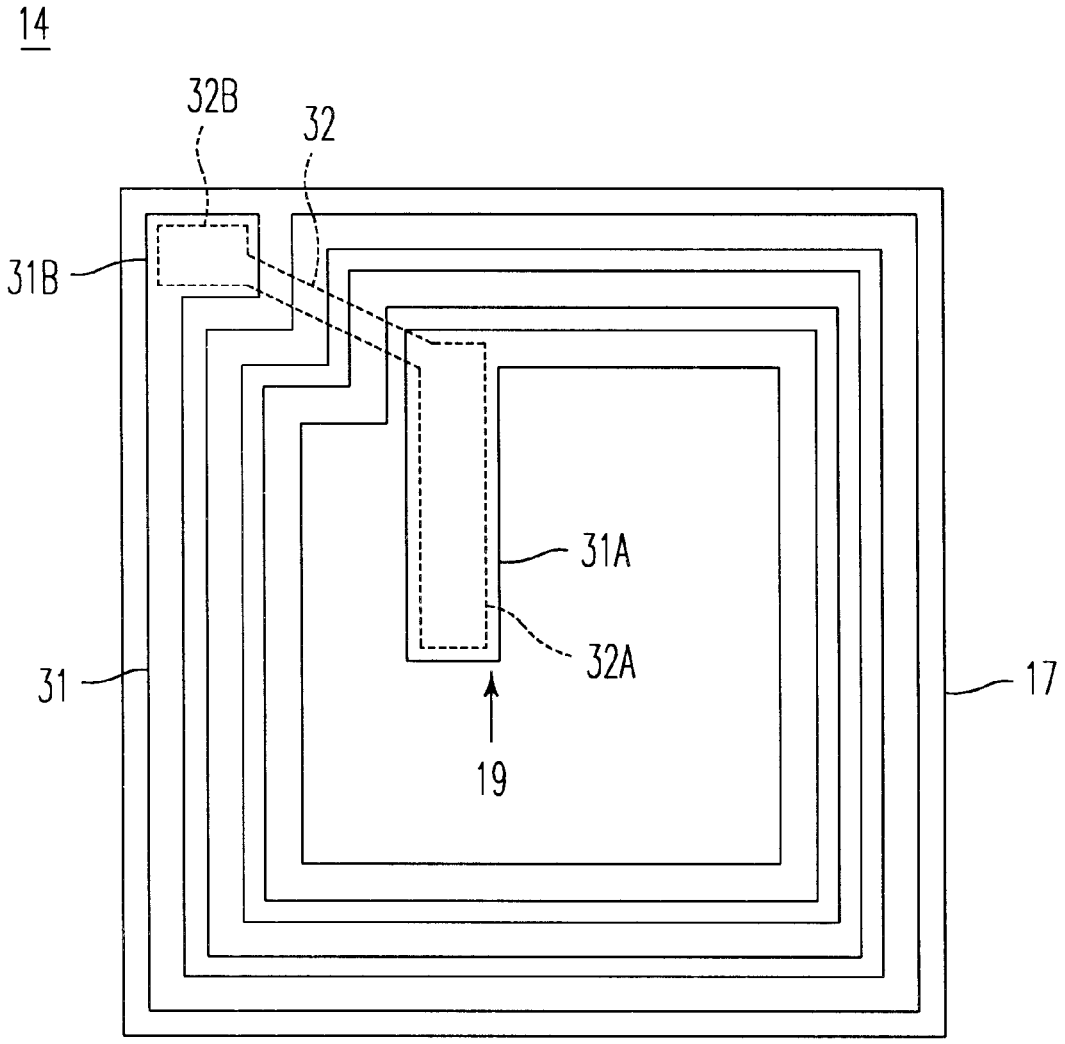
FIG. 4 is a plan view showing a resonant circuit section in the embodiment 1.

A resonant circuit section 14 shown in FIG. 4 was formed. That is, an insulating base sheet 17 was prepared which was composed of a thin polyethylene of 5 cm long and 5 cm wide and had aluminum foils bonded on both the sides thereof by an adhesive. A coil portion 31, having a first electrode portion 31*a* and a first terminal portion 31*b* at the internal end and the external end thereof were printed to the aluminum foil of one of the surfaces of the polyethylene using an etching resistant paint by silk screen. A terminal section 32 having a second electrode portion 32*a* and a second terminal portion 32*b*, which confronted the first electrode portion 31*a* and the first terminal portion 31*b* at both the ends thereof, were printed to the aluminum foil of the other surface of the polyethylene by the silk screen as shown by the broken line in the figure. Etching was performed after the paint was dried. Subsequently, the first terminal portion 31*b* was caused to come into contact with the second terminal portion 32*b* under pressure by compressing and breaking the polyethylene therebetween, whereby the resonant circuit section 14 was formed by forming a capacitor 19 by the first terminal portion 31*b* and the second terminal portion 32*b*.

A tag was obtained by bonding an electromagnetic shield layer composed of a styrol sheet as an insulating material which was 5 cm long, 5 cm wide and 1 cm thick. The tag 1 was referred to as an example 1.

EXAMPLE 2

Although not shown, Ni—Zn sintered ferrite was pulverized in a mortar and ground in a ball mill. Subsequently, Ni—Zn sintered ferrite powder was prepared by causing the thus ground Ni—Zn sintered ferrite to pass through a sieve having a particle size of 10 $\mu$m. 90 wt % of the powder and 10 wt % of an epoxy resin were sufficiently blended in a small amount of acetone and put into a mold, and an electromagnetic shield layer composed of an epoxy resin sheet, which was 5 cm long, 5 cm wide and 5 mm thick and in which the ferrite powder was dispersed, was obtained. A tag was obtained by bonding the electromagnetic shield layer to the resonant circuit section obtained in the example 1. The tag was referred to as an example 2.

EXAMPLE 3

Although not shown, 90 wt % of soft magnetic iron powder having an average particle size of 2 $\mu$m and 20 wt % of an epoxy resin were sufficiently blended in a small amount of acetone and put into a mold, and an electromagnetic shield layer composed of an epoxy resin sheet, which was 5 cm long, 5 cm wide and 5 mm thick and in which soft magnetic iron powder was dispersed, was obtained. A tag was obtained by bonding the electromagnetic shield layer to the resonant circuit section obtained in the example 1. The tag was referred to as an example 3.

EXAMPLE 4

Although not shown, an epoxy resin sheet, which was 5 cm long, 5 cm wide and 3.5 mm thick and in which ferrite powder was dispersed, was obtained by a procedure similar to that of the example 2. An electromagnetic shield layer composed of a laminated body was obtained bonding a styrol sheet, which was 5 cm long, 5 cm wide and 3 mm thick, to the resin sheet. A tag was obtained by bonding the electromagnetic shield layer to the resonant circuit section obtained in the example 1. The tag was referred to as an example 4.

EXAMPLE 5

A resonant circuit section was made to a shape similar to that of the example 1. A first layer was not used in an electromagnetic shield layer and an acrylic sheet as an insulating material which was 5 cm long, 5 cm wide and 10 mm thick was used as the second layer of the electromagnetic shield layer. The electromagnetic shield layer was bonded to the resonant circuit section. Further, an aluminum sheet which was 5 cm long, 5 cm wide and 0.3 mm thick was used as a high conductivity layer. A tag was obtained by bonding the high conductivity layer to the front surface of the electromagnetic shield layer. The tag was referred to as an example 5.

EXAMPLE 6

A resonant circuit section was made to a shape similar to that of the example 1. A second layer was not used in an electromagnetic shield layer and a Ni—Zn ferrite composite material was used as the first layer of the electromagnetic shield layer. The composite material was made by sufficiently blending 80 wt % of Ni—Zn sintered ferrite powder, which was ground to a particle size of 10 $\mu$m or less, and 20 wt % of an epoxy resin in a small amount of acetone, putting them in a mold and solidifying them therein. The size of the composite material was 5 cm long, 5 cm wide and 2 mm thick. The electromagnetic shield layer was bonded to the resonant circuit section. A high conductivity layer was made of a material similar to that of the high conductivity layer of the example 5 and formed to a shape similar to the shape thereof. A tag was obtained by bonding the high conductivity layer to the front surface of the electromagnetic shield layer. The tag was referred to as an example 6.

EXAMPLE 7

A tag similar to that of the example 6 except that a high conductivity layer was made of a copper sheet which was 5 cm long, 5 cm wide and 0.3 mm thick. The tag was referred to as an example 7.

EXAMPLE 8

A tag similar to that of the example 6 except that a high conductivity layer was made of an aluminum foil which was 5 cm long, 5 cm wide and 15 $\mu$m thick was made. The tag was referred to as an example 8.

EXAMPLE 9

A tag similar to that of the example 6 except that a high conductivity layer was made of a silver thick film which was 5 cm long, 5 cm wide and 10 μm thick was made. The tag was referred to as an example 9.

EXAMPLE 10

A tag similar to that of the example 6 except that a high conductivity layer was made of an ITO film which was 5 cm long, 5 cm wide and 10 μm thick was obtained. The tag was referred to as an example 10.

EXAMPLE 11

A tag similar to that of the example 6 except that an electromagnetic soft iron composite material was used as the first layer of an electromagnetic shield layer was made. The tag was referred to as an example 11. Note that the electromagnetic soft iron composite material was made by sufficiently blending 80 wt % of soft magnetic iron powder, which was ground to a particle size of 10 μm or less, and 20 wt % of an epoxy resin in a small amount of acetone, putting them in a mold and solidifying them therein. The size of the composite material was 5 cm long, 5 cm wide and 2 mm thick.

EXAMPLE 12

A tag was made similarly to the example 6 except that an acrylic sheet was interposed between the first layer of an electromagnetic shield layer and a high conductivity layer as the second layer of the electromagnetic shield layer. The tag was referred to as an example 12. The size of the second layer was 5 cm long, 5 cm wide and 1 mm thick.

COMPARATIVE EXAMPLE 1

Although not shown, a tag composed of only the electromagnetic shield layer obtained in the example 1 was referred to as a comparative example 1.

COMPARATIVE EXAMPLE 2

Although not shown, a tag was made similarly to the example 5 except that the second layer of an electromagnetic shield layer was not used. The tag was referred to as a comparative example 2.

COMPARATIVE EXAMPLE 3

A tag was made similarly to the example 5 except that no high conductivity layer was used. The tag was referred to as a comparative example 3. However, Ni—Zn sintered ferrite powder and epoxy resin were 60 wt % and 40 wt %, respectively.

COMPARATIVE EXAMPLE 4

A tag was made similarly to the example 11 except that no high conductivity layer was used. The tag was referred to as a comparative example 4. However, soft magnetic iron powder and epoxy resin were 60 wt % and 40 wt %, respectively.

COMPARATIVE EXAMPLE 5

A tag was made similarly to the example 12 except that no high conductivity layer was used. The tag was referred to as a comparative example 5. However, Ni—Zn sintered ferrite powder and epoxy resin were 60 wt % and 40 wt %, respectively.

Comparison Test 1 and Evaluation

The resonant circuit sections of the tags of the examples 1–4 were bonded on aluminum sheets of 6 cm long, 6 cm wide and 0.3 mm thick through electromagnetic shield layers, and the resonant circuit section of the comparative example 1 was bonded directly on an aluminum sheet having the same size without interposing an electromagnetic shield layer therebetween. These tags were caused to pass between a transmitting antenna, which transmits a radio wave with which the resonant circuit sections resonate, and a receiving antenna standing at a predetermined interval, respectively. Then, it was confirmed whether a speaker connected to the control output of a controller issued a warning or not.

As a result, a warning was issued in the tags of the examples 1–4, while no warning was issued in the tag of the comparative example 1. It is contemplated that this is because the self-inductance of the resonant circuit sections did not almost change in the examples 1–4, although a self-inductance changed in the tag of the comparative example 1 because the tag was bonded on the aluminum sheet. Note that the types and thicknesses of the electromagnetic shield layers of the examples 1–4 and the comparative example 1 are shown in Table—1.

TABLE 1

| | Electromagnetic shield layer | | High conductivity | Detection rate (%) | | |
|---|---|---|---|---|---|---|
| | First layer (Thickness) | Second layer (Thickness) | layer (Thickness) | Frequency 5 MHz | Frequency 8 MHz | Frequency 10 MHz |
| Example 1 | nil | Styrol sheet (10 mm) | nil | — | — | — |
| Example 2 | Ferrite composite material (5 mm) | nil | nil | — | — | — |
| Example 3 | Soft magnetic iron composite material (5 mm) | nil | nil | — | — | — |
| Example 4 | Ferrite composite material (3.5 mm) | Styrol sheet (3 mm) | nil | — | — | — |
| Example 5 | nil | Acrylic sheet (10 mm) | Aluminum sheet (0.3 mm) | 36 | 35 | 33 |
| Example 6 | Ferrite composite material (2 mm) | nil | Aluminum sheet (0.3 mm) | 69 | 68 | 67 |

TABLE 1-continued

| | Electromagnetic shield layer | | High conductivity | Detection rate (%) | | |
|---|---|---|---|---|---|---|
| | First layer (Thickness) | Second layer (Thickness) | layer (Thickness) | Frequency 5 MHz | Frequency 8 MHz | Frequency 10 MHz |
| Example 7 | Ferrite composite material (2 mm) | nil | Copper sheet (0.3 mm) | 64 | 64 | 63 |
| Example 8 | Ferrite composite material (2 mm) | nil | Aluminum foil (15 μm) | 64 | 64 | 63 |
| Example 9 | Ferrite composite material (2 mm) | nil | Silver thick film (10 μm) | 61 | 61 | 59 |
| Example 10 | Ferrite composite material (2 mm) | nil | ITO film (10 μm) | 61 | 61 | 59 |
| Example 11 | Soft magnetic iron composite material (2 mm) | nil | Aluminum sheet (0.3 mm) | 59 | 59 | 55 |
| Example 12 | Ferrite composite material (2 mm) | Acrylic sheet (1 mm) | Aluminum sheet (0.3 mm) | 69 | 69 | 68 |
| Comparative Example 1 | nil | nil | nil | 0 | 0 | 0 |
| Comparative Example 2 | nil | nil | Aluminum sheet (0.3 mm) | 0 | 0 | 0 |
| Comparative Example 3 | Ferrite composite material (2 mm) | nil | nil | 0 | 0 | 0 |
| Comparative Example 4 | Soft magnetic iron composite material (2 mm) | nil | nil | 0 | 0 | 0 |
| Comparative Example 5 | Ferrite composite material (2 mm) | Acrylic sheet (1 mm) | nil | 0 | 0 | 0 |

In Table—1, a "ferrite composite material" shows a "Ni—Zn ferrite composite material".

<Comparative Test 2 and Evaluation>

Respective ones of antitheft tags 52 made by the examples 5–12 and the comparative examples 1–5 were prepared and bonded on laminated boxes 11 (boxes of 175×65 mm×30 mm on which foils mainly composed of aluminum were laminated) as articles whose theft was monitored at the corners of one surfaces thereof. Further, a transmitting antenna (300 mm wide×1670 mm high) 13 and a receiving antenna (300 mm wide×1670 mm high) 23 were disposed at an interval of 900 mm and a radio wave having a predetermined frequency was oscillated from the transmitting antenna.

Figure 7:
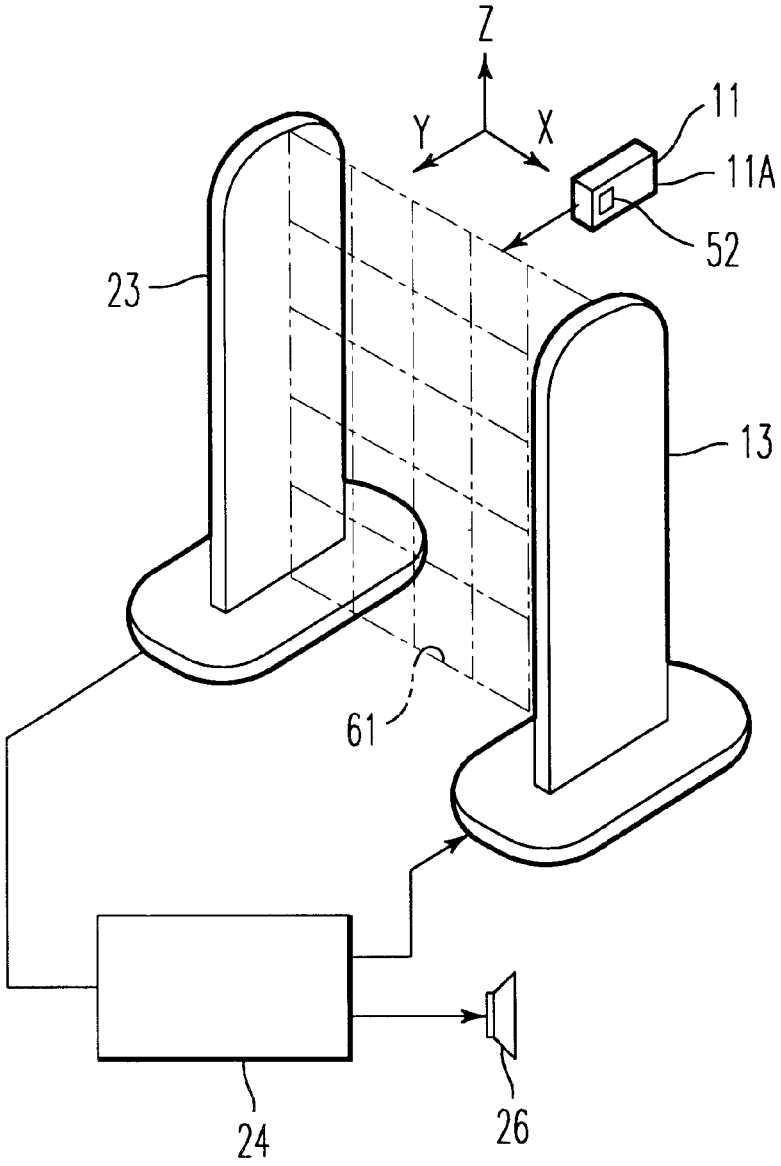
FIG. 7 is a view corresponding to FIG. 3 and shows a state that an article on which the tag is mounted passes between a transmitting antenna and a receiving antenna.

In contrast, the space between both the antennas was divided into 25 small spaces 61 as shown by the two-dot-and-dash-line of FIG. 7. In this state, the respective laminated boxes 11 provided with the tags were caused to pass between both the antennas 13, 23 so that they pass through the respective small spaces 61. At the time, the tag 25 was caused to pass through one small space 61 three times by changing the direction thereof so that it is perpendicular to X-, Y- and Z-axes. That is, each laminated box 11 provided with the tag was caused to pass between both the antennas 13 and 23 while changing the positions where it passes as well as changing the direction of the tag 52 75 times in total. Then, whether the tag 52 could be sensed or not when it passed between the antennas 13 and 23 was measured and a tag sensing rate (%) was calculated. Table—1 shows the result of the calculation. Note that the frequency of the radio wave oscillated from the transmitting antenna was changed to 5 MHz, 8 MHz and 10 MHz. In addition, Table—1 shows the types and thicknesses of the electromagnetic shield layers and the high conductivity layers of the tags of the examples 5–12 and the comparative examples 1–5.

As apparent from Table—1, the tags of the comparative examples 2–6 could not be sensed at all, whereas 33–69% of the tags of the examples 5–12 could be sensed. As a result, the characteristics of the tags could be greatly improved.

Note that it is contemplated that a reason why any of the tag sensing rates of the comparative examples 3–5 was zero is that the electromagnetic shielding function of the tags was lowered because the thickness of the electromagnetic shield layer (2 mm when only the first layer was employed and 2 mm+1 mm when the first layer and the second layer were employed) was too thin regardless of that no high conductivity layer was provided or because the content of the ferrite powder or the soft magnetic iron powder was too small (60 wt %).

As described above, according to the, present invention, the antitheft tag, which is mounted on an article whose theft is monitored, includes the resonant circuit section which is in resonance with the radio wave having the particular frequency and transmitted from the transmitting antenna. Since the electromagnetic shield layer, which is composed of the insulating material or the composite material or which is formed by laminating the first layer composed of the composite material and the second layer composed of the plastic or the like, is interposed between the mounting surface of tile article and the resonant circuit section, the resonant circuit section is electromagnetically shielded by the electromagnetic shield layer while being space apart from the article by the predetermined interval which corresponds to the thickness of the electromagnetic shield layer. As a result, the self-inductance of the resonant circuit section does not almost change. That is, the resonance frequency of the resonant circuit section is approximately the same as that when the antitheft tag is mounted on an article the surface of which is formed of an insulating material or a non-magnetic material.

Further, when the high conductivity layer is interposed between the mounting surface of the article and the electromagnetic shield layer, the resonant circuit section is electromagnetically shielded from the article by the electromagnetic shield layer as well as the Q value of the resonant circuit section can be increased. As a result, the self-inductance of the resonant circuit section does not almost change as well as a resonant width is made sharp. Further, since the thickness of the electromagnetic shield layer can be greatly reduced by interposing the thin high conductivity layer, the thickness of the tag can be reduced as a whole as well as the tag can be made at a low cost.

In particular, when the electromagnetic shield layer contains the soft magnetic powder having a particle size of 10 $\mu$m or less, the occurrence of an eddy current can be suppressed in the electromagnetic shield layer even if the frequency of the radio wave transmitted from the transmitting antenna is high. Consequently, the thickness of the electromagnetic shield layer can be reduced without almost changing the self-inductance of the resonant circuit section. When the electromagnetic shield layer is interposed which is formed by laminating the first layer and the second layer, the thickness of the first layer (composite material) can be reduced and the amount of the ferrite powder or the soft magnetic powder used can be decreased, whereby a less expensive tag can be provided.

Further, when the soft magnetic powder is used and it is composed of any of the amorphous alloy, Fermalloy, soft magnetic iron, silicon steel, Sendust alloy and Fe—Al alloy, the resonant circuit section can be electromagnetically shielded reliably from the article the surface of which is formed of the conductive material or the ferromagnetic material because the magnetic permeability of these insulating materials is large, the coercive force thereof is small and the hysteresis loss thereof is small.

When the high conductivity layer is used and it is formed of the non-magnetic material having the electric resistivity of $10^{-2}$ $\Omega$·cm or less such as the aluminum sheet, copper sheet, ITO film or silver thick film, the Q value can be increased because the high conductivity layer has high electric conductivity and is non-magnetic.

Further, when the tag having no high conductivity layer is mounted on the article whose theft is monitored using the front surface of the electromagnetic shield layer as the surface to be mounted on the article and when the tag having the high conductivity layer is mounted on the article whose theft is monitored using front surface of the high conductivity layer as the surface to be mounted on the article, the tags can be properly mounted on the article without being affected thereby.

What is claimed is:

1. An antitheft tag which is mounted on an article the theft of which is monitored and which includes a resonant circuit section configured to resonate with radio waves having a particular frequency that are transmitted from a transmitting antenna, comprising:

an electromagnetic shield layer interposed between a mounting surface of the article and the resonant circuit section; and a high conductivity layer interposed between the mounting surface of the article and said electromagnetic shield layer.

2. An antitheft tag according to claim 1, wherein said high conductivity layer is formed of a non-magnetic material having an electric resistivity of $10^{-2}$ $\Omega$·cm or less.

3. An antitheft tag according to claim 2, wherein said high conductivity layer is formed of any of an aluminum sheet, a copper sheet, an aluminum foil, an ITO film and a silver thick film.

4. A method of mounting an antitheft tag according to claim 2 on an article, wherein the antitheft tag is mounted on the article using the front surface of the high conductivity layer of the tag as the surface to be mounted on the article.

5. A method of mounting an antitheft tag according to claim 3 on an article, wherein the antitheft tag is mounted on the article using the front surface of the high conductivity layer of the tag as the surface to be mounted on the article.

6. A method of mounting an antitheft tag according to claim 1 on an article, wherein the antitheft tag is mounted on the article using the front surface of the high conductivity layer of the tag as the surface to be mounted on the article.

7. An antitheft tag according to claim 1, wherein said electromagnetic shield layer is formed of an insulating material.

8. An antitheft tag according to claim 1, wherein said electromagnetic shield layer is composed of a composite material of ferrite powder and plastic or rubber.

9. An antitheft tag according to claim 1, wherein said electromagnetic shield layer is composed of a composite material of soft magnetic powder which has a particle size of 10 $\mu$m or less and plastic or rubber.

10. An antitheft tag according to claim 1, wherein said electromagnetic shield layer is formed by laminating a first layer composed of a composite material of ferrite powder or soft magnetic powder which has a particle size of 10 $\mu$m or less and plastic or rubber and a second layer composed of plastic or rubber.

* * * * *